United States Patent [19]

Triouleyre et al.

[11] Patent Number: 4,510,785

[45] Date of Patent: Apr. 16, 1985

[54] AUTOMATIC SHEET METAL FOLDING MACHINE

[75] Inventors: Jean Triouleyre, Meriel; Jean Rousselin, Jouy en Josas; Patrick Schmit, Bouzonville; Philippe Gondry, Saint Quentin, all of France

[73] Assignee: Ets. Y. Jouanel S.A., Gentilly, France

[21] Appl. No.: 395,833

[22] Filed: Jul. 6, 1982

[30] Foreign Application Priority Data

Jul. 7, 1981 [FR] France ..... 81 13349

[51] Int. Cl.[3] ..... B21D 5/04

[52] U.S. Cl. ..... 72/323; 72/320; 72/311; 72/319

[58] Field of Search ..... 72/319–323, 72/311, 316, 293, 387, 388

[56] References Cited

U.S. PATENT DOCUMENTS

| | | | |
|---|---|---|---|
| 3,022 | 3/1843 | Latta | 72/293 |
| 275,741 | 4/1883 | Wren | 72/323 |
| 520,262 | 5/1894 | Geissinger | 72/320 |
| 654,373 | 7/1900 | Wikstrom | 72/388 |
| 655,903 | 8/1900 | Martin | 72/323 |
| 960,910 | 6/1910 | Hazen | 72/319 |
| 1,775,864 | 9/1930 | Olson | 72/311 |
| 2,102,439 | 12/1937 | Schildmeier | 72/311 |
| 2,221,539 | 11/1940 | Gehret | 72/311 |
| 3,116,779 | 1/1964 | Procter et al. | 72/321 |
| 3,344,633 | 10/1967 | Wilson | 72/320 |
| 4,092,840 | 6/1978 | Eckold et al. | 72/321 |

FOREIGN PATENT DOCUMENTS

| | | | |
|---|---|---|---|
| 659978 | 3/1963 | Canada | 72/307 |
| 70701 | 3/1950 | Denmark | 72/387 |
| 256984 | 2/1913 | Fed. Rep. of Germany | 72/320 |
| 472250 | 11/1914 | France | 72/320 |
| 2403126 | 4/1979 | France . | |
| 405208 | 7/1966 | Switzerland | 72/320 |

*Primary Examiner*—Daniel C. Crane

*Attorney, Agent, or Firm*—James & Franklin

[57] ABSTRACT

An automatic sheet metal folding machine comprises two gripping members and upper and lower folding members disposed respectively above and below the gripping members. The folding members are pivotally mounted about pivot axes generally fixed during folding operations. The gripping members are adapted to clamp the sheet of metal therebetween and bring the sheet of metal to an upper or lower horizontal reference plane for folding, or some position therebetween. The upper folding member folds sheet metal downwardly and the lower folding member folds sheet metal upwardly, thereby avoiding having to turn over the sheet of metal. An orientation table may be associated with the actual folding machine for turning around a sheet of metal between successive folding operations and/or feeding and discharging the sheet of metal into and out of the folding machine.

15 Claims, 13 Drawing Figures

AUTOMATIC SHEET METAL FOLDING MACHINE

BACKGROUND OF THE INVENTION

The present invention relates to automatic sheet metal folding machines.

Generally speaking, known types of sheet metal folding machines comprise a frame having two vertical pillars, the spacing of which defines the maximum width of sheet metal to be folded, a horizontal table fixed to the frame and adapted to support the sheet metal to be folded, a gripping member vertically displaceable for clamping the sheet metal against the table and having a leading edge for defining the folding line, and a folding member which does the actual folding. In known constructions the folding member is disposed in the front of the frame below the upper horizontal plane of the table and it is pivotable about an upper horizontal axis so that its upper edge, in contact with the sheet metal to be folded, folds the same to the desired angle. To take into account the radii of folding and the thickness of the steel metal, means are provided for adjusting the position of the pivot axis of the folding member relative to the table.

The folding of sheet metal in a known folding machine is generally carried out in the following manner:

After adjusting the pivot axis of the folding member as a function of the folding parameters, the operator places a sheet of metal so that the folding line which is marked beforehand coincides with the working edge of the table which obviously corresponds to the working edge of the gripping member. Then he lowers the gripping member to clamp the sheet metal into position and thereafter he actuates the drive mechanism for the folding member to pivot the latter to the desired angle, the folding always being carried out in a single vertical direction, i.e., downwardly.

If the sheet of metal must be folded in the opposite direction along another line, the operator must turn the sheet of metal over to bring the new folding line into coincidence with the working edge of the table and then repeat the above described steps.

Further, if the sheet of metal must be folded in the same direction, but on the opposite side and along another line, the operator must pivot the sheet horizontally through 180° to reorient the new folding line to coincide with the working edge of the table before repeating the actual folding operation.

This brief description of the folding steps brings out the handling problem posed with known machines and it shows that most of the time required for folding the sheet metal is taken up by the manual displacement operations.

In French printed patent application No. 2,307,592 an automatic folding machine is disclose in which the sheet of metal is disposed in a fixed vertical position between two gripping member with horizontal leading edges pivotally mounted on the fixed frame. The machine comprises two folding members disposed symmetrically with respect to the sheet of metal and mounted on supports pivotally mounted for folding the sheet metal in one direction or the other. This arrangement avoids having to turn the sheet of metal over between two successive folding operations, but the arrangement of the gripping members pivotally mounted on the frame does not enable the sheet metal to be folded on its opposite edge. Further, the mounting of the folding members which permits considerable displacement thereof may be detrimental to accuracy especially when there are high stresses.

French printed patent application No. 2,403,126 and European printed patent application No. 0 022 22 22 teach machines for folding the edge of a sheet of metal in which the sheet metal is held in a fixed horizontal position while a single, U-shaped working member having a leading surface at the end of each one of the legs is displaceable for folding the edge of the sheet metal upwardly or downwardly. The possibilities of such a machine are limited by the dimensions of the working member, in particular the width and the depth of the U-section.

OBJECT AND SUMMARY OF THE INVENTION

An object of the invention is to provide a machine which carries out automatically the steps of adjusting the machine, folding the sheet metal in both direction and orienting the sheet metal between two folding operations, and which has a wide power range and a wide range of folding dimensions.

According to the invention there is provided an automatic sheet metal folding machine comprising a fixed frame, gripping members for clamping a metal sheet to be folded, two folding members independently pivotally mounted about pivot axes parallel to the working edges of the gripping members, the folding members being disposed to opposite sides of the gripping members, each of the folding members including a folding tool having an edge defining a work plane of the folding machine, means for positioning the folding lines for the metal sheet, means for adjusting the folding lines for the metal sheet, means for adjusting the spatial position of the pivot axes of the folding members, means for producing and coordinating various movements of the folding machine. The automatic folding machine is characterized by the gripping members being movable with respect to the frame for bringing the metal sheet to a folding position at one of the folding members, the pivot axes of the folding members being fixed relative to the frame during folding except for small magnitude shifting to compensate for variations in the thickness of the metal sheets.

As it will be understood the machine according to the invention has novel sheet metal and folding member movement principles. In the prior art the metal sheet is fixed relative to the frame and in the machines permitting folding in two opposite directions, the folding members are disposed toward the metal sheet. In the machine according to the invention, on the contrary, there are two folding positions fixed relative to the frame, and the metal sheet is displaced toward one of the folding positions depending on the desired folding operation.

Preferably, the one of the folding members is disposed vertically above the gripping members and the other folding member below the gripping members, the gripping members being superposed, and displaceable toward respective folding members. The lower gripping member having greater horizontal dimensions than the upper gripping member so as to function also as a sheet supporting table. The means for producing and coordinating the various movements of the folding machine comprises means for connecting and operating the gripping members, for providing relative vertical movement of the gripping members, for clamping and unclamping the metal sheet therebetween, and a vertical movement of both gripping members together to selectively position them at upper and lower horizontal work planes and other suitable intermediate positions.

A structure in which the metal sheet is held in a horizontal position results in simpler handling operations than those of the structure of French printed patent application No. 2,307,692 in which the metal sheet is vertical and must therefore be held on its opposite sides during any displacement.

According to other features of the preferred embodiment of the invention:

The means for connecting and operating the gripping members comprises ball-and-groove drive means.

The means for positioning the folding line for the metal sheet comprises adjustable abutments mounted on arms connected to the rear part of the lower gripping member defining the sheet supporting table and against which the rear edge of the metal sheet to be folded bears. The abutments are displaceable independently of each other on the arms in a direction perpendicular to the clamping jaw of the lower gripping member, and the arms are displaceable parallel to the clamping jaw for varying the relative spacing between the rear abutments, means being provided for producing the movements of the rear abutments and the arms.

Means for orienting the metal sheet to be folded comprises one or more tables disposed at the rear of the folding machine, each of the tables being connected to the folding machine by a corresponding track for executing by appropriate associated means a rotational movement about the vertical axis of the table to turn the metal sheet to the desired angle of orientation, and a translatory movement in a direction perpendicular to the horizontal axes of the folding members and reintroducing metal sheet into the machine after changing its orientation, the table being provided with suitable means for fixing the metal sheet in position during the sequence of movements, the means for fixing the metal sheet being magnetic members, suction members, clamps, or the like.

The means for adjusting the spatial position of the horizontal axes of the upper and lower folding members comprises slideways fixed to the lateral portions of the respective folding members and angled at 45° relative to their median longitudinal plane and slidable in response to an automatic or manual adjustment mechanism on the slides disposed at the ends of the corresponding fixed pivots, and means for securing the slides in their respective adjusted positions.

The control and coordination of the various movements of the component parts of the folding machine is ensured by a digital control system which may include a computer.

These and other features and advantages of the invention will be brought out in the description which follows, given by way of nonlimiting example, with reference to the accompanying drawings.

DETAILED DESCRIPTION OF THE PREFERRED EMBODIMENTS

Figure 1:
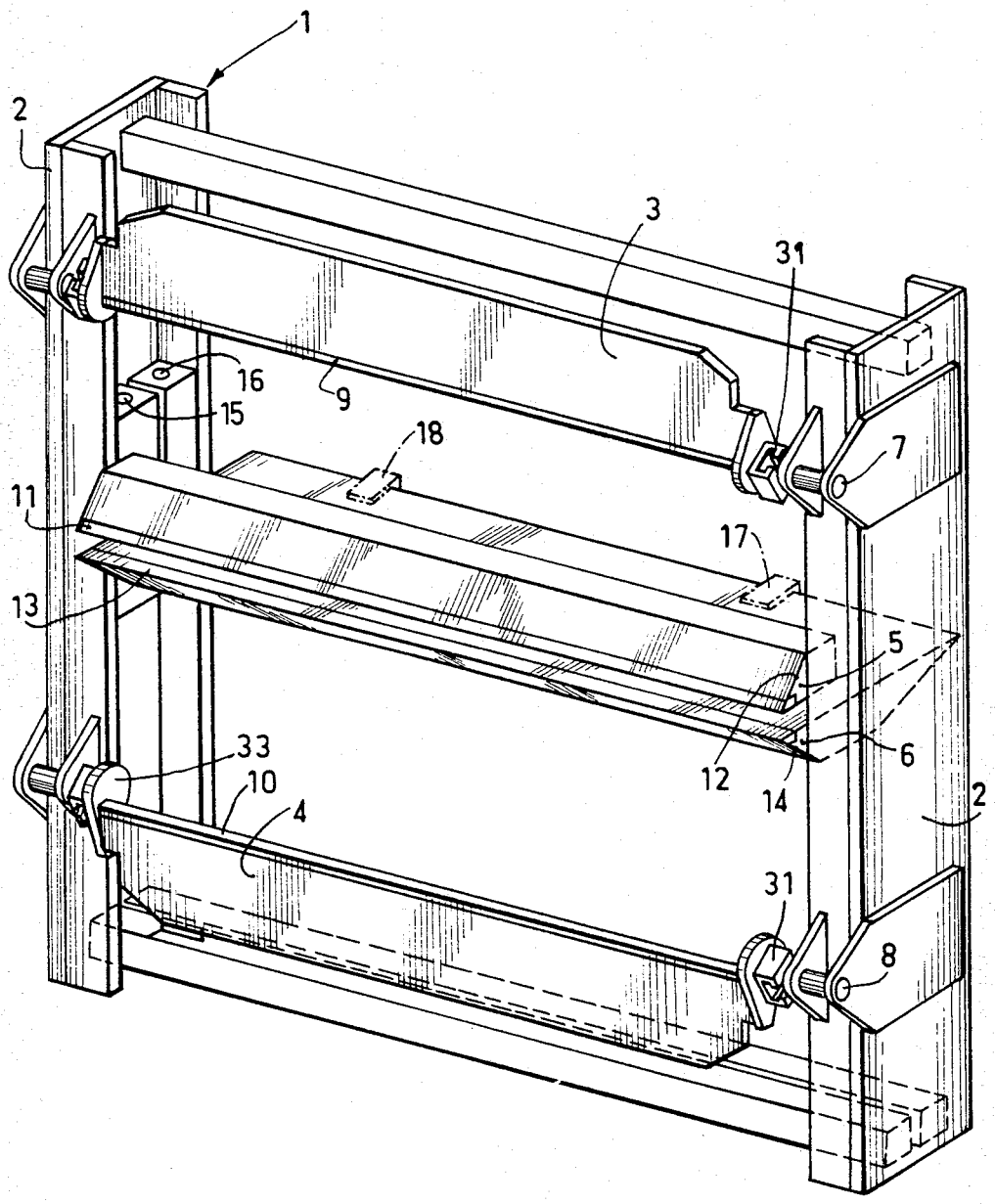
FIG. 1 shows a perspective view of the front of the automatic sheet metal folding machine embodying the invention.

The automatic sheet metal folding machine, shown in perspective view in FIG. 1, comprises a fixed frame 1 provided with pillars 2 of U-shaped section interconnected by upper and lower horizontal cross members. The frame 1 is made of welded sheet metal.

Before continuing with the description of the folding machine the meaning of the terms "front" and "rear", which will be very important in defining the relative positions of the component parts and the directions of rotation, must be specified. Taking the frame 1 as the reference, the term "front" designates the side into which the sheet metal is introduced and the term "rear" designates the opposite side.

In contrast to known sheet metal folding machines which comprise a fixed table adapted to support the sheet metal to be folded and fixed to the frame, and a lower folding member, the present folding machine comprises at the front an upper folding member 3 and a lower folding member 4, the sheet metal to be folded being displaced to a folding position by the respective folding members with the assistance of two gripping members 5,6, defining a gripping unit which is verticaly movable in slideways fixed to the pillars 2 of the frame 1.

The upper folding member 3 is pivotally mounted on the frame of the folding machine by means of fixed pivots 7 which are aligned so as to define a horizontal pivot axis. The lower folding member 4 is pivotally mounted in the same way an the frame 1 by means of fixed pivots 8 defining a horizontal pivot axis. The two folding members 3,4 carry respective folding tools 9, 10 along their working edges, i.e., at the bottom of the upper folding member 4 and at the top of the lower folding member 3. Further, the folding members 3,4 are coupled by their respective fixed pivots 7,8, by adjustment means which will be described in detail below and which permits the changing of the position of the working edges of the folding members with respect to the corresponding pivot axes as a function of the folding parameters, viz., the thickness and the mechanical properties of the sheet metal to be folded, the folding radius, the direction of rolling, etc.

When the folding members 3,4 are in their rest position, the uppermost edge of the folding tool 10 of the lower folding member 4 and the lowermost edge of the folding tool 9 of the upper folding member 3 define the respective horizontal planes $P_1$, $P_2$ for the start of folding and constitute very important reference planes in which the sheet of metal to be folded must be transfered before the beginning of actual folding operation.

The folding operation is performed by means of the gripping members 5,6. The upper gripping member 5 comprises a lower horizontal clamping surface which is terminated at its forward end by a clamping strip or jaw 11. In addition its front face 12 is rearwardly and upwardly angled or inclined at 45° as shown in FIG. 1, in conformity with a feature of the invention which will be explained below.

The lower gripping member 6 comprises an upper horizontal clamping surface which is terminated by a clamping strip or jaw 13. The upper horizontal surface has a surface area greater than the lower horizontal clamping surface of the upper gripping member 5 so as to also act a table for supporting the sheet of metal to be folded. Additionally, the forward face of the lower gripping member 6, designated by reference 14 in FIG. 1, is inclined rearwardly and downwardly at an angle of 45° for the same reason as the 45° angle of the front face 12 of the upper gripping member 5.

Figure 2:
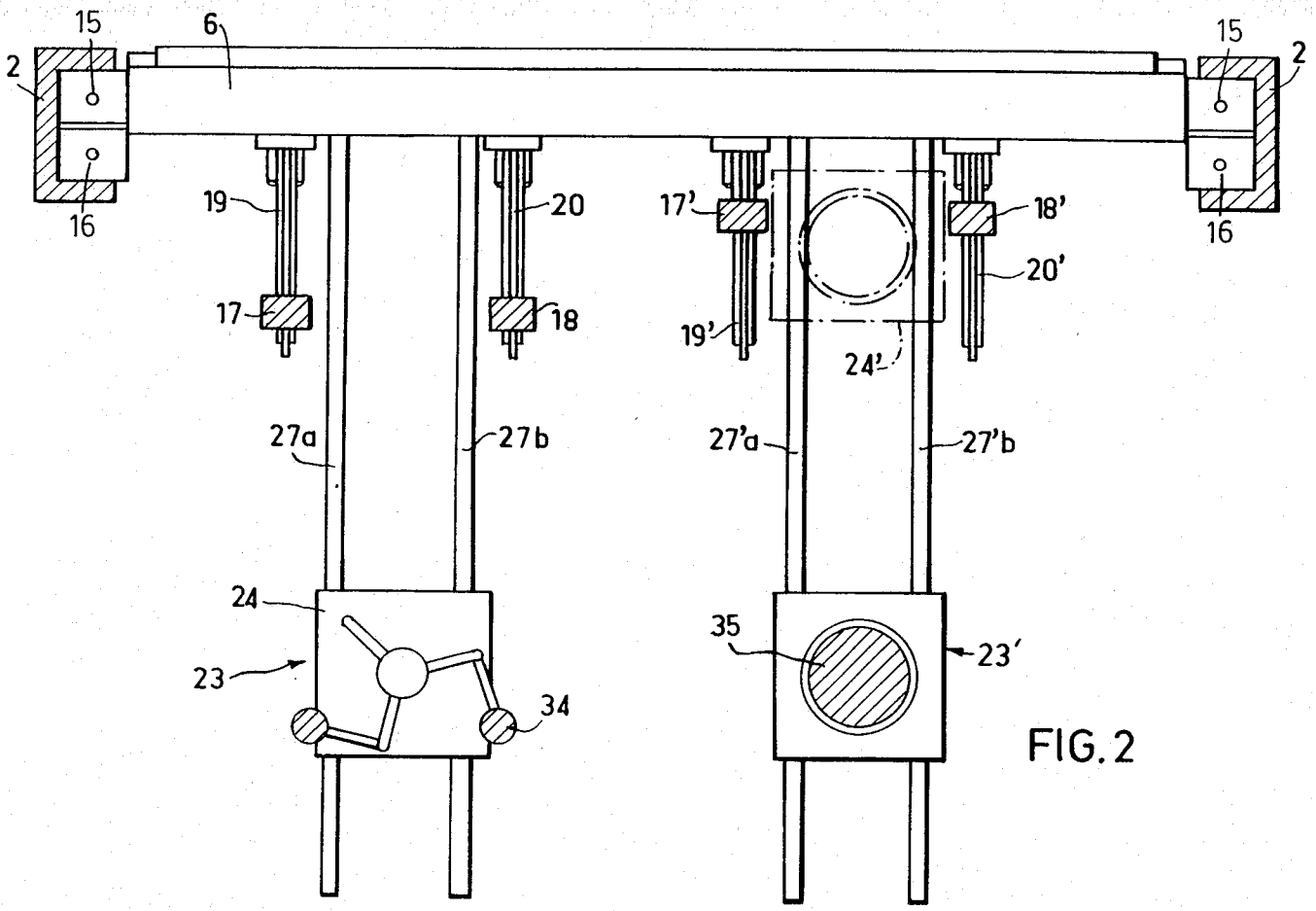
FIG. 2 is a top plan view of the folding machine.

The two gripping members 5,6 are mounted at their lateral ends in drive means, designated respectively by references 15 and 16 in FIGS. 1 and 2. The first drive means 15 permits the relative displacement of the gripping members 5 and 6 for clamping and unclamping the metal sheet to be folded whereas the second drive means 16 permits vertical displacement of the gripping unit defined by both gripping members 5,6 together between the two reference horizontal planes $P_1$, $P_2$ defined by the lowermost edge of the upper folding member 5 and the uppermost edge of the lower folding member 4. To facilitate movement of the folding members 3 and 4 relative to their drive means it is advantageous to form the same by worms with rows of balls which permit better force transmission than conventional drive means such as, for example, a threaded spindle with a displaceable nut which has considerable frictional losses. The first drive means 15 and the second drive means 16 preferably comprises ball-and-groove drive means.

The structure which has just been described comprises the actual folding system of the folding machine. A sheet of metal engaged between the gripping members 5,6 so as to bear on the lower gripping member 6 is clamped between the two gripping members and it may be carried to one of the aforesaid reference planes, i.e., the upper horizontal plane $P_1$ when the sheet of metal is to be folded downwardly by the upper folding member 3 and the lower horizontal plane $P_2$ when the sheet of metal is folded upwardly by the lower member 4.

However, after the start of the actual folding operation, the line along which the sheet of metal is to be folded must be adjusted correctly with respect to the folding tools. To solve this problem means for positioning the folding line is provided on the lower gripping member 6 and comprises members engageable with the rear edge of the sheet of metal to adjust the folding line in the correct position with respect to the working edge of the clamping jaw of the lower gripping member 6.

Figure 3:
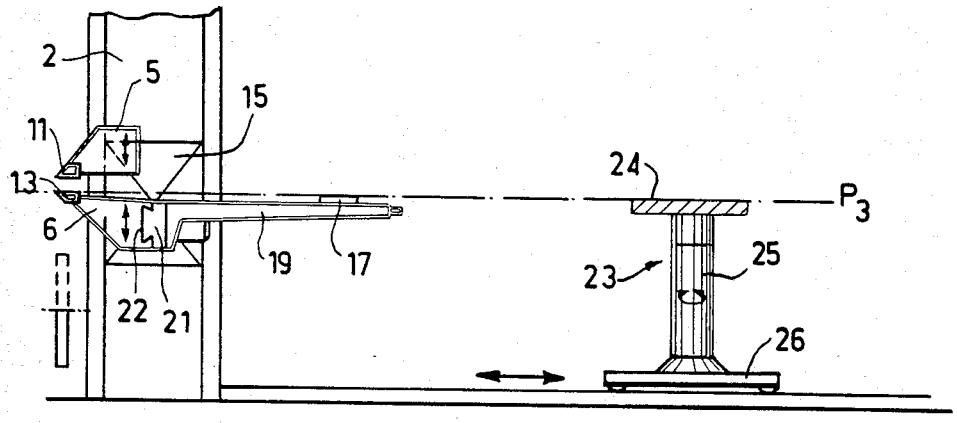
FIG. 3 is a cross-sectional view of the folding machine.

An embodiment of the means for positioning the folding line will now be described with reference to FIGS. 2 and 3. The means for positioning the folding line comprises two rear abutments 17, 18 which are mounted on the respective arms 19, 20 fixed to the lower gripping member 6 and having their longitudinal direction oriented perpendicular to the clamping jaw 13 of the lower gripping member 6. The rear abutments 17, 18 are displaceable longitudinally by independent motor-driven mechanisms, for example, a threaded spindle and nut arrangement, to move toward or away from the working edge of the clamping jaw 13. In addition the arms 19, 20 are slidable by a drive comprising a slide 21 and a dovetail slideway 22 along the lower gripping member 6 which provides a displacement of the abutments 17, 18 parallel to the clamping jaw 13 of the lower gripping member 6. It is also to be noted that each rear abutment 17, 18 is provided with means for fixing the position of the sheet of metal. The means for fixing the sheet of metal may be magnetic members, suction members, clamps or other suitable fixing means.

It is therefore seen that by relative displacement of the two rear abutments 17, 18, in the direction perpendicular to the working edge of the clamping jaw 14 of the gripping member 6 it is possible, without manual intervention by the operator, to make the folding line coincide with the working edge in relation with the angle of inclination of the folding line relative to the rear edge of the sheet of metal. The relative movement of the arms 17, 18 is also carried out by an independent motor-driven mechanism and its purpose is to adjust the spacing of the abutments relative to the corresponding dimension of the sheet of metal to be folded with the orientation means which will be described below.

The maximum angle to which the rear edge of the sheet of metal may be inclined relative to the working edge of the clamping jaw 13 on the lower gripping member 6 by means of the rear abutments 17,18 is necessarily limited by the pathway of the rear abutments in the direction perpendicular to the clamping jaw. To avoid this angular limitation and especially to permit a horizontal rotation of the sheet of metal through 180° in either direction for folding the opposite edge, there is provided, in conformity with a feature of the invention, sheet orientation means.

In the embodiment illustrated in FIG. 2, the sheet orientation means comprises a table 23 including a table top 24, e.g. of square shape, which is intended to support and hold the sheet of metal and is provided with means thirty four, 35 for fixing the sheet metal in position such as magnetic members, suction members, or other suitable clamping means. The table top 24 is mounted in a support 25 rotatable about its axis, the support 25 being fixed to a base 26 which slides or rools along track formed in this embodiment by two rails **27*a*, 27*b***, which are joined to the base of the actual folding machine, perpendicular thereto.

The track may be connected to the folding machine in the same way as the arms 19, 20 carrying the rear abutments 17, 18 to effect a translatory movement in a direction parallel to the clamping jaw 13 of the lower gripping member 6 for the reason which will be explained below. It should also be observed that the plane defined by the table top 24 constitutes an important reference plane for the folding machine, as will be explained below.

According to an interesting modified embodiment the rails **27*a*, 27*b*** are replaced by an elevated track from which the rotatable orientation table is supported, thereby clearing the ground.

For the sheet orientation table to operate properly relative to the rear abutment 17, 18 two conditions must be satisfied:

the assembly comprising the arms carrying the rear abutments 17, 18 must be centered or aligned along the axis of the track; and the adjustment of the spacing between the arm 19, 20 carrying the abutments must be such that the sheet orientation table 23 can pass between the abutments 17, 18.

After defining the essential components of the automatic sheet metal folding machine of the invention the operation of the machine will be described with reference to FIGS. 4A–4D which illustrate the various stages of the automatic folding of a sheet of metal.

Figure 4A:
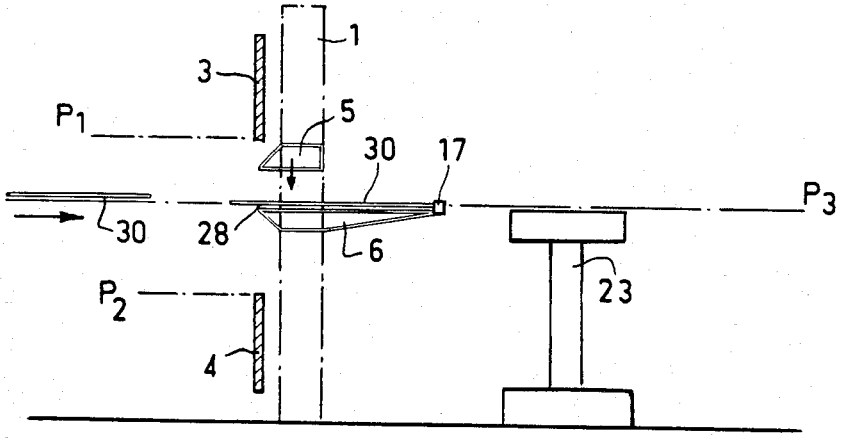
FIGS. 4A–4D are diagrammatic views illustrating the operation of the various parts of the folding machine.
Figure 4B:
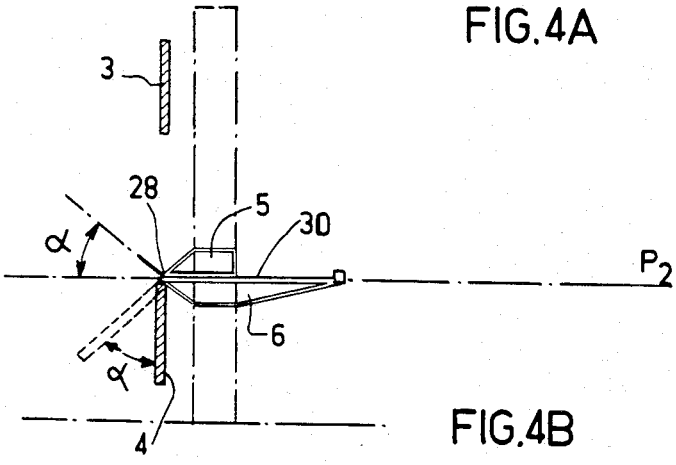

In FIG. 4A, the sheet 30 of metal is positioned manually by the operator or automatically by a feed conveyor, not shown in the drawings, on the lower gripping member 6 which functions as a support. The sheet 30 comes into contact along its rear edge with rear abutments 17,18 which were preadjusted in position in accordance with a predetermined folding program so that the first folding line 28 of the sheet 30 coincides with the forward edge of the clamping jaw 13 of the lower gripping member 6. The sheet 30 is held against movement in this adjusted position by fixing means which are provided on the rear abutments 17,18. As indicated by the downwardly directed vertical arrow, the upper gripping member 5 is displaced downwardly so as to bear against the sheet 30 and clamp it in position against the lower gripping member 6 and at the same time, assuming that the sheet 30 is to be folded upwardly, both gripping members 5,6 are lowered together to the lower horizontal reference plane $P_2$ in FIG. 4A;

In FIG. 4B, the lower folding member 4 is then displaced by pivotal movement upwardly about its horizontal axis 8 so as to fold the sheet 30 through an angle $\alpha$ about the first folding line 28. Then, assuming that the sheet 30 must be folded downwardly about a second folding line 29, both gripping members 5,6 are displaced upwardly to the upper horizontal reference plane $P_1$. When the gripping members reach the upper reference plane $P_1$ the upper gripping member 5 is moved away from the lower gripping member 6 and the rear abutments 17,18 are operated, as indicated at 1 in FIG. 4C so as to adjust the second folding line 29 into coincidence with the working edge of the lower gripping member 6. The lower gripping member 5 is again brought to bear against the sheet 30 to clamp it in position in the upper reference plane $P_1$. The next folding operation can then commence.

Figure 4C:
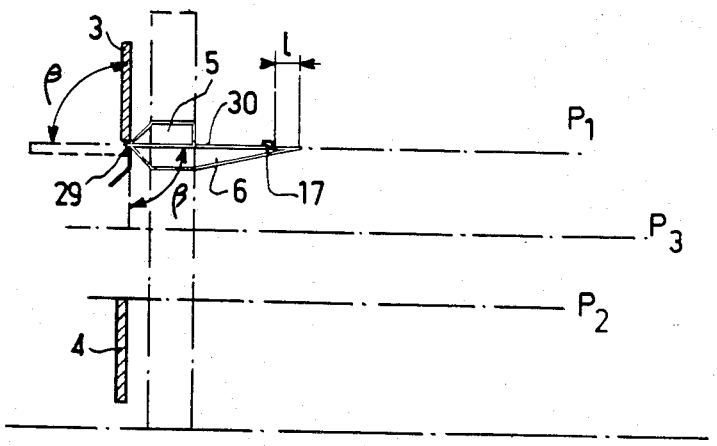

In FIG. 4C, the upper folding member 3 is rotated about its lower pivot axis through an angle $\beta$ so as to make the desired fold or bend about folding line 29. After the folding operation, both gripping members 5,6 are lowered to the intermediate reference plane $P_3$. At the end of a folding sequence the folded sheet 30 is removed from the machine by the operator or by a discharge conveyor, not shown. However, when a folding operation must be carried out on the opposite edge of the sheet, the sheet must be turned around as illustrated in FIG. 4D.

Figure 4D:
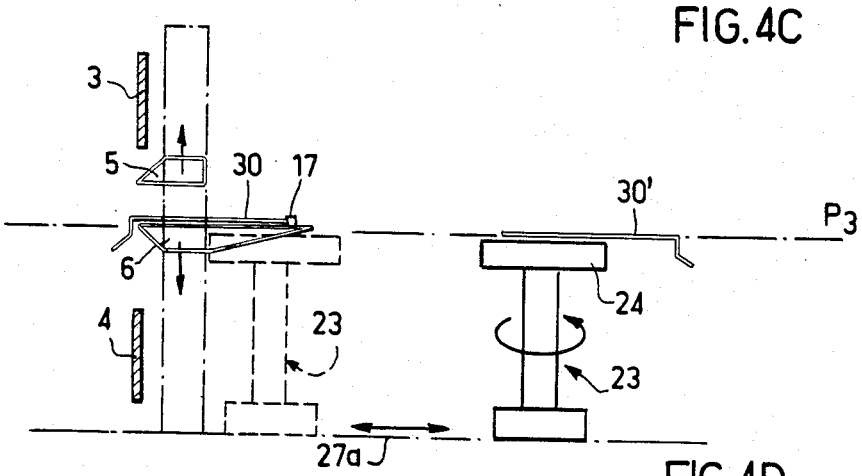

In FIG. 4D, the sheet orientation means comprising the orientation table 23 is brought into action. The orientation table 23 is moved from a retracted rearward position to a relatively forward position, shown in dashed lines, where it is under the sheet 30 which is already in place on the lower gripping member 6. The gripping member 6 is then lowered, the arms 19,20 carrying the abutments 17,18 can effect this lowering movement without touching the orientation table 23 since their relative position has been adjusted accordingly. During this movement the sheet 30 is arrested in the intermediate reference plane $P_3$ by the table top 24, with the fixing means 34,35 holding the sheet 30 in position. The table 23 effects a transfer movement in the opposite direction, i.e. away from the folding machine, and it also effects, at the same time, a rotational movement about the axis of its support 25 to bring the sheet to the position 30' in FIG. 4D. The thus-reoriented sheet is then reintroduced into the machine by another transfer movement of the orientation table 23. The lower gripping member 6 is again raised to take control of the sheet, with the coordination of the fixing means on the orientation table 23 and those of the lower gripping member 6. Thereafter the rear abutments 17,18 of the lower gripping member 6 may again perform their function of adjusting the position of the new folding line; the subsequent steps are carried out in conformity with the previous description in connection with FIGS. 4A, 4B and 4C.

In the illustration of FIG. 4D, the orientation table 23 may be reoriented also to an angle other than 180° in order to orient a folding line at a suitable position which cannot be effected by the rear abutments 17,18.

In the preceding embodiment, the orientation table 23 comes into action only for orienting or reorienting the sheet of metal. It is possible, however, to provide that it also function during the sheet feed and discharge operations, the track being constructed accordingly. In particular if the orientation table is suspended from an elevated track, it is advantageous to provide that it is also vertically movable and the track is constructed and arranged to permit the table to pick up the metal sheets from a conveyor or a pallet and/or drop them off, after folding, at a discharge device.

Figure 8:
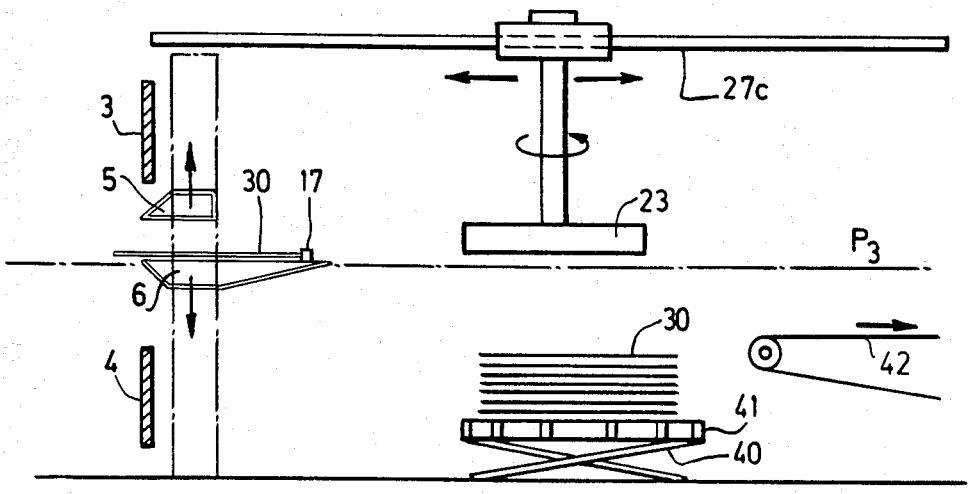
FIG. 8 is a diagrammatic view similar to that of FIG. 4A for a modified embodiment.

FIG. 8 illustrates an embodiment according to such a variant. In this embodiment the elevated track comprises rails 27c from which the orientation table 23 is suspended, the orientation table being provided with magnetic members or suction members and being rotatable about a vertical axis.

The feed means here comprises a cross-bar linkage lift 40 which carries a pallet 41 on which metal sheets 30 to be folded in the folding machine are stacked. The discharge means here comprises a band conveyor 42. The table 23 is displaceable along the track for transporting the metal sheets between the pallet 41, the folding machine and the discharge means 42, while having the possibility of orienting the metal sheets for the various operations in the folding machine, as described above.

It should be noted that the sheet handling means, described above with reference to FIGS. 4A–4D, and more particularly to FIG. 8, constitute a virtual robot which may be used in conjunction with other machines, for example, forming, piercing, cutting, blanking or stamping machines.

Other features of the folding machine of the invention will now be described and, in the first place, the adjustment of the position of the folding members with respect to their fixed axes of rotation.

Figure 5A:
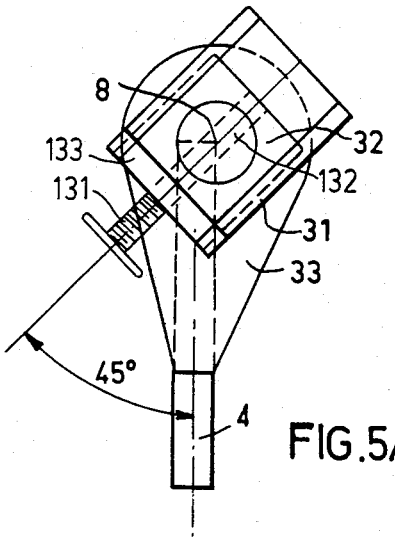
FIGS. 5A and 5B are elevational and cross-sectional views of the mechanism for adjusting the lower folding member relative to its fixed pivots.
Figure 5B:
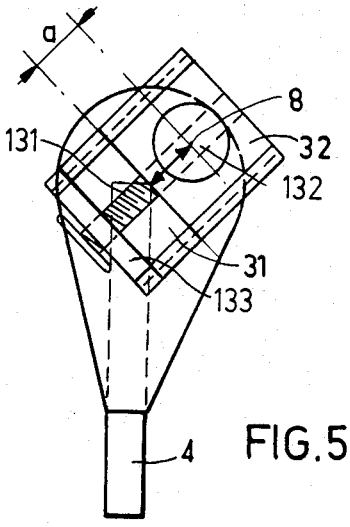

In this respect reference will be had to FIGS. 1, 5A and 5B. FIG. 1 shows that the axes of rotation of the upper and lower folding members 3,4 are fixed. Taking into account the various parameters of folding, such as the thickness and the nature of the sheet metal, the direction of rolling, the folding radius, and the like, the position of the body of the folding member must be adjusted with respect to the pivot axis before carrying out a folding sequence. In known machines such an operation was accomplished by means of complicated mechanisms precluding the automation of the process. The present folding machine comprises, to this end, improvements which permit both manual or automatic adjustments. Owing to the arrangement of the upper and lower folding members being symmetrical with respect to a horizontal plane, only one of these will be described below.

The lower folding member 4 comprises along its lateral sides flanges 33 for carrying pivots 8. On each flange 33 is fixed a slideway 31 comprising a groove which is oriented after fixing the slideway in position, at 45° with respect to the median longitudinal plane of the folding member 4. The groove receives a slide 32 which in turn is fixed to the corresponding pivot 8 of the folding member 4.

It is thus possible, when the corresponding folding member is in its rest position, to displace the leading or working edge in a plane inclined at 45° with respect to the vertical direction passing through the fixed axis, this plane being downwardly extending from the axis for the lower folding member 4 and upwardly extending from the axis in case of the upper folding member 3. This arrangement makes the adjustments simpler than in conventional sheet folding machines. For a given thickness e and a folding radius r, the axis of the folding member, i.e., the slide 32, has to be displaced in the slideway 31 a distance equal to $(e+r)\sqrt{2}$. To produce this displacement a simple mechanism such as a screw 131 is used, which extends through the body of the slide inclined at an angle of 45° and threaded into a tapped hole 132 in a base 133 integral with the slideway and fixed in its groove. This mechanism may be operated by manual adjustment of the screw. If it is desired to mechanize this movement, an intermittent drive motor is provided along the axis of the screw for driving the same.

Figure 6:
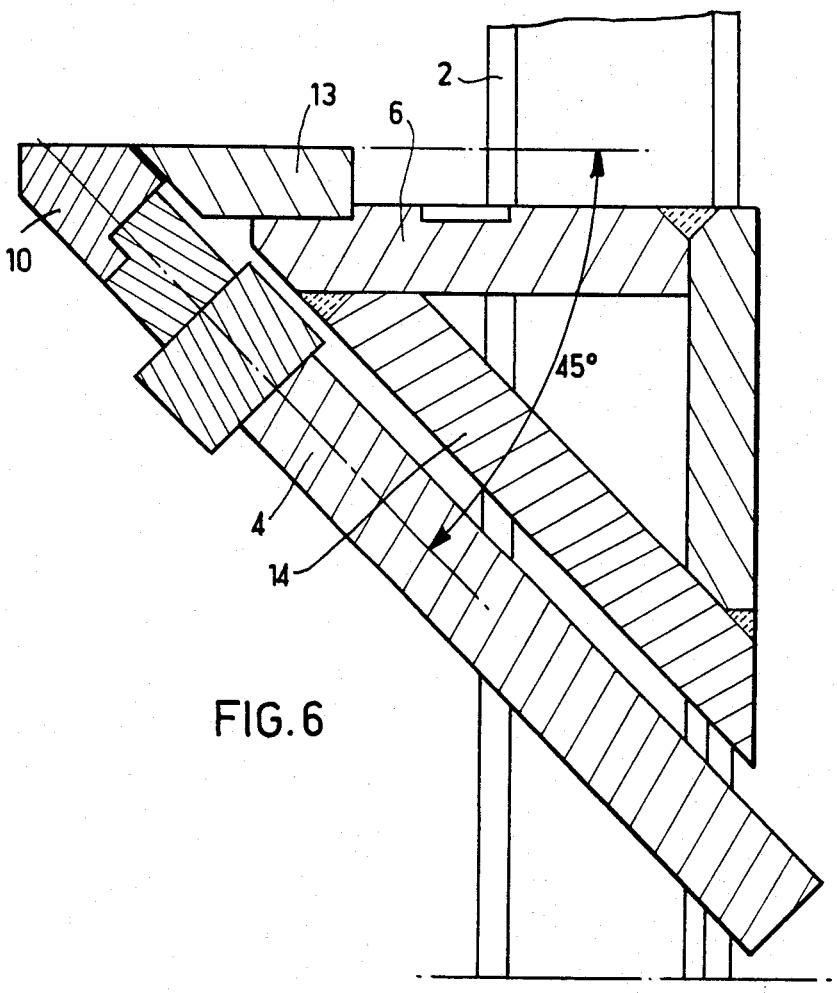
FIG. 6 is a cross-sectional view of the lower gripping member and the lower folding member at a rearwardly sloping angle of 45°.

Another feature of the folding machine of the invention which distinguishes it over the prior art relates to the possibility of initially rearwardly inclining one of the folding members 3,4 to a position at an angle of 45° with respect to the intermediate reference plane of the folding machine. This initial adjustment is made possible by the structure shown in FIG. 6, which is a cross-sectional view of the lower gripping member 6 and the lower folding member 4. By contrast, with known constructions in which the part taking the place of the lower gripping member functioning as a table has a boxlike structure, the lower gripping member 6 of the present folding machine has a triangular cross section and comprises a forward surface 14 which is inclined rearwardly and downwardly at 45° thereby permitting the initial adjustment of the lower folding member 4 to a position parallel to the forward surface 14, as shown in FIG. 6. However, to begin the folding from the corresponding reference plane, here lower plane $P_2$, the folding member must be equipped with a folding tool 10 having the cross section shown in FIG. 6.

Figure 7A:
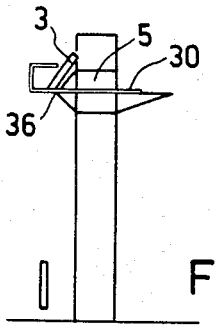
FIGS. 7A and 7B illustrate a folding procedure for sheet metal with a folding member initially rearwardly inclined at an angle of 45°.
Figure 7B:
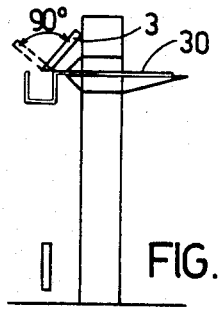

In this respect FIGS. 7A and 7B clearly show a mode of working a sheet of metal which was previously folded and which is to be folded along another folding line designated by reference 36, can only be effected by initially placing the folding member 3 in a position rearwardly offset at 45°.

Another feature of the folding machine is the fact that it permits a fold to be terminated in the form of a curl, that is a fold in which the edge of the sheet is bent backwards through an angle of 180°. In this case a rought folding with a tool permits a folding angle of about 170°. Then the extremity of the sheet is placed between the clamping jaws of the upper and lower gripping members and the upper gripping member is lowered so as to push the bent-over edge toward the plane of the sheet to complete the 180° fold. The upper gripping member functions as a press punch in this case.

It goes without saying that in order to execute the various movement the folding machine is equipped with suitable motors, transmission means and means for adjusting the length and angle of the strokes, i.e, electrical, hydraulic, pneumatic or other means. Further, the machine may be equipped for controlling and coordinating the various movements, with a simple digital control system of a digital control system with a computer. It may also be provided with suitable display devices for displaying the various folding parameters.

Also, the folding machine may have, side by side, between the pillars 2 of the frame 1, several work stations of which two are schematically illustrated in FIG. 2. It is then possible to fabricate several sheets at the same time, of different dimensions but geometrically similar. Each work station is provided with a pair of rear abutments 17,18 or 17',18' and an orientation table 23 or 23'.

In addition it should be noted that the folding machine may be installed in an automatic production line and in this event the feeding of the sheets to the work stations and the discharge of the finished parts are effected automatically by known means.

The invention is, of course, not limited to the illustrated and described embodiments, but various other modes and may be made by those skilled in the art without departing from the spirit and scope of the invention.

What we claim is:

1. An automatic sheet metal folding machine comprising a fixed frame, two gripping members aligned in one direction relative to said frame for clamping a metal sheet to be folded and having parallel working edges and parallel gripping surfaces with said gripping surfaces extending perpendicular to said one direction, each of said folding members including a folding tool having a surface defining a work plane on said folding machine, means for positioning the desired folding lines of a metal sheet with respect to the working edge of a gripping member, drive means able to move said gripping members for clamping a metal sheet to move said gripping members together with a clamped metal sheet as a unit with respect to said frame successively in said one direction towards each different one of said folding members, means for fixedly supporting the pivots of said folding members during folding operations, and means for adjusting the position of said pivots by small magnitude movements.

2. The folding machine of claim 1, wherein each of said gripping members has a plane clamping surface terminated at the front of said machine by a clamping jaw cooperating with the folding tool of one of said folding members, said folding members being respectively disposed each on each side of said gripping members with regard to said one direction, said gripping members being superposed and displaceable toward either of said folding members, the lower gripping member having in a direction perpendicular to said one direction greater dimensions than the upper gripping member so as to function as a sheet supporting table.

3. The folding machine of claim 1, wherein said drive means comprise ball-and-groove drive means.

4. The folding machine of claim 1, wherein said means for positioning the folding lines for a metal sheet comprises rear abutments against which the rear edge of the metal sheet bears, said rear abutments being displaceable independently of each other in a direction perpendicular to one of said gripping members.

5. The folding machine of claim 4, wherein said rear abutments are mounted for displacement on arms connected to the rear of said one gripping member, said arms being displaceable in a direction parallel to the forward edge of said one gripping member for adjusting the relative spacing between said rear abutments.

6. The folding machine of claim 1, in combination with at least one sheet orientation table at the rear of said folding machine connected to the latter by a track, said sheet orientation table being mounted for rotational movement about its vertical axis to rotate the metal sheet to a desired angle of orientation, said sheet orientation table being mounted for translatory movement in a direction perpendicular to said horizontal pivot axes of said folding members so as to move the metal sheet away from said folding machine for changing its orientation and to reintroduce the metal sheet into said folding machine after changing its orientation, and means for fixing the metal sheet on said table during said movements comprising magnetic members.

7. The folding machine of claim 1, said one direction being vertical and said machine being disposed in combination with at least one track and at least one sheet orientation table at the rear of said folding machine connected to the latter by said track, said sheet orientation being mounted for rotational movement about its vertical axis to rotate the sheet metal to the desired angle of orientation, said sheet orientation table also being mounted for translatory movement along said track perpendicular to said horizontal pivot axes of said folding members so as to move the metal sheet away from said folding machine for changing its orientation and to reintroduce the metal sheet into said folding machine after changing its orientation, and means for fixing the metal sheet on said orientation table during said movements comprising suction members.

8. The folding machine of claim 1, wherein said means for adjusting the spatial position of said pivot axes of said folding members comprise slideways fixed to the lateral portions of the respective folding members, said slideways being at an angle of 45° with respect to the median longitudinal plane of their respective folding members, slides fixed to pivots defining said pivot axes and in sliding engagement with said slideways, means for adjusting the position of said slides relative to said slideways, and means for securing said slides in their adjusted position.

9. The folding machine of claim 1, wherein said gripping members comprise upper and lower gripping members, each of said gripping members comprising a front face inclined rearwardly at 45° relative to planes passing through the fixed pivot axes of said folding members, said folding members being angularly adjustable up to 45° about their fixed pivot axes in their inclined positions at the start of folding, rearwardly relative to a reference plane extending through the pivot axes of the respective folding members parallel to the clamping and unclamping direction of said gripping members.

10. The folding machine of claim 1, said one direction being vertical, said machine having a plurality of work stations, each of said work stations being provided with one of said sheet orientation tables.

11. The folding machine of claim 10, wherein each of said work stations further comprises feed and discharge conveyors for metal sheets, said conveyors having means for holding the metal sheets.

12. The folding machine of claim 7, wherein said track and sheet orientation table cooperate to feed metal sheets to be folded into said folding machine and discharge folded metal sheet therefrom.

13. The folding machine of claim 7, wherein said track is disposed above said sheet orientation table.

14. The folding machine of claim 1 wherein said folding members are independently mounted for operation in alternating sequence, interrupted by movement of said gripping members as a unit with respect to said frame, whereby one of more sequential operations by one of said folding members may be followed, after said movement of said gripping members as a unit, by one or more sequential operations of the other of said folding members.

15. The folding machine of claim 2 wherein said clamping jaw cooperates with the folding tool of the one of said folding members disposed on the opposite side of the metal sheet.

* * * * *